United States Patent [19]

Tokizane et al.

[11] Patent Number: 4,813,888

[45] Date of Patent: Mar. 21, 1989

[54] HIGH-FREQUENCY CABLE CONNECTOR

[75] Inventors: Toshiaki Tokizane; Hideo Hayashi; Takayuki Iseki; Ikuhisa Morimoto; Tooru Yamada, all of Kadoma, Japan

[73] Assignee: Matsushita Electric Works, Ltd., Osaka, Japan

[21] Appl. No.: 101,505

[22] Filed: Sep. 28, 1987

[30] Foreign Application Priority Data

Oct. 15, 1986 [JP] Japan ..... 61-244430
Feb. 27, 1987 [JP] Japan ..... 62-45447

[51] Int. Cl.[4] ..... H01R 17/18

[52] U.S. Cl. ..... 429/583; 439/578; 439/675

[58] Field of Search ..... 439/916, 581, 645, 435, 439/409, 410, 394, 534–540, 95, 98, 99, 107, 108, 578–585, 675, 668, 669; 174/51, 59, 60, 75 C, 88 C, 71 C

[56] References Cited

U.S. PATENT DOCUMENTS 3,543,222 11/1970 Rheinfelder ..... 439/394
3,622,945 11/1971 Winston et al. ..... 439/539
4,280,749 7/1981 Hemmer ..... 439/578
4,358,174 11/1982 Dreyer ..... 439/578
4,403,820 9/1983 Rich ..... 439/394
4,428,632 1/1984 Rich ..... 439/578
4,509,809 4/1985 Wang ..... 339/14 R
4,708,414 11/1987 Lam ..... 439/394
4,747,786 5/1988 Hayashi et al. ..... 439/578

FOREIGN PATENT DOCUMENTS 0163276 12/1985 European Pat. Off. ..... 439/578
2130888 1/1972 Fed. Rep. of Germany ..... 439/578

*Primary Examiner*—David Pirlot
*Attorney, Agent, or Firm*—Burns, Doane, Swecker & Mathis

[57] ABSTRACT

A high-frequency cable connector for relaying coaxial cables led from two different sides to each other comprises a case body having a receptacle for a terminal plug of one of the cables, a holder for holding an inner contactor for contacting therewith the inner conductor of a cable within the case body, a conducting shield plate secured to the bottom of the case body while exposing part of the holder to the exterior, and a cap plate rotatably mounted to the shield plate and holding the other coaxial cable. The connector allows the two coaxial cables to be connected in an extremely simpler manner, the connector itself can be installed along with any other type or same type of wiring devices, and respective components can be assembled in a single direction so as to render efficient its mass production.

10 Claims, 5 Drawing Sheets

HIGH-FREQUENCY CABLE CONNECTOR

BACKGROUND OF THE INVENTION

This invention relates to high frequency cable connectors to be installed on interior wall surface of buildings.

The connector of this kind can be effectively utilized in relay-connecting between at least a pair of coaxial cables one of which is connected to a television antenna or the like installed on a roof of the building and the other of which is connected to a relay-antenna terminal plate installed onto outer a television receiver or the like.

For known high-frequency cable connectors of the kind referred to, an example has been disclosed in U.S. Pat. No. 4,509,809 to Cheng-Shi Wang, in which there are provided a terminal for connection thereto of a coaxial cable connected to a TV receiver or the like and another terminal for connection thereto of another coaxial cable connected to a TV antenna or the like. The cables are respectively guided onto front and rear faces of a base body of the connector for connection with a relay-connecting means in the base body. The cables are fastened by means of a cover or protective plate.

This connector of Wang is advantageous in that the cables and connector terminals can be connected with each other without the use of any fixing screw, but there are involved certain problems In particular, the arrangement in which the TV receiver cable is inserted between the base body and the cover renders this connector improper for allowing the relay-connection to be completed in a single motion of inserting a plug-like terminal member provided to an end of the coaxial cable. Further, as the TV antenna cable must be guided so as to extend from one side edge to an inside point of the base body within a plane including the base body, it becomes necessary to install this connector onto an interior wall surface while disposing the entire base body on the wall surface, so as to render the asthetic appearance unsatisfactory. It has been also defective in that it is difficult to construct the connector to in a modular dimension substantially of the same dimensions as other modular-dimensioned wiring devices so as to be exchangeably installed with such device or devices. Further, as the relay-connection means must be provided to each of the front and rear surfaces of the base body, the constituent parts are required to be assembled from both sides of the base body so that the manufacturing has been practically complicated.

A primary object of the present invention, therefore, is to provide a high-frequency cable connector which allows a plug-shaped terminal member provided to an end of the coaxial cable to be connected in a single inserting motion, the installation of the connector to the wall surface to be made without disposing base body part as exposed on the wall surface, a concurrent installation with any wiring device of different or the same type to be performed, and all constituent parts to be installed sequentially from one side of the base body during the manufacture.

According to the present invention, the above object can be attained by providing a high-frequency cable connector for relay-connection between coaxial cables led from two different sides, which comprises a case body having in a front surface a receptacle for receiving a plug provided to an end of one of the cables and an outer contactor disposed in the receptacle for connection with an outer conductor of the cable, the case body being opened on bottom side, an inner contactor holder disposed within the case body and having a compartment for accommodating therein first one of first and second different shaped contacting parts of an inner contactor, the contacting parts being respectively contactable with each of inner and outer conductors of the cable from one of the two different sides, a conducting shield plate provided to the open bottom of the case body to shield the same while exposing the accommodating compartment of the contactor holder to the exterior but closing the rest of the open bottom, the shield plate being coupled to an extended leg portion of the outer contactor, and a cap member pivoted at an end to the shield plate at a position close to the exposed compartment of the contactor holder to be rotatable at the other end where the cap member is fixed through a screw to the shield plate for holding the other side cable between the shield plate and the cap member while contacting the outer conductor of the other side cable with the shield plate.

With the above high-frequency cable connector according to the present invention in which the receptacle for one of the cables as well as the rotatable cap member for holding the other cable are concurrently provided, the two coaxial cables can be connected to each other through a simpler motion required, while the receptacle disposed to be accessible from the front side allows the connector to be installed so as to have the front surface of the connector disposed substantially flush with the interior wall surface, to keep the appearance excellent. Since the connector can be subjected to a modular dimension in association with the same or different type of the wiring device, the connector can be arranged to be exchangeably or concurrently mounted with such other wiring devices As the assembling work of the connector can be completed only from a single direction with respect thereto, the connector can be made high in the mass productivity.

Other objects and advantages of the present invention will be made clear in the following description of the invention detailed with reference to embodiments of the invention shown in accompanying drawings.

Figure 1:
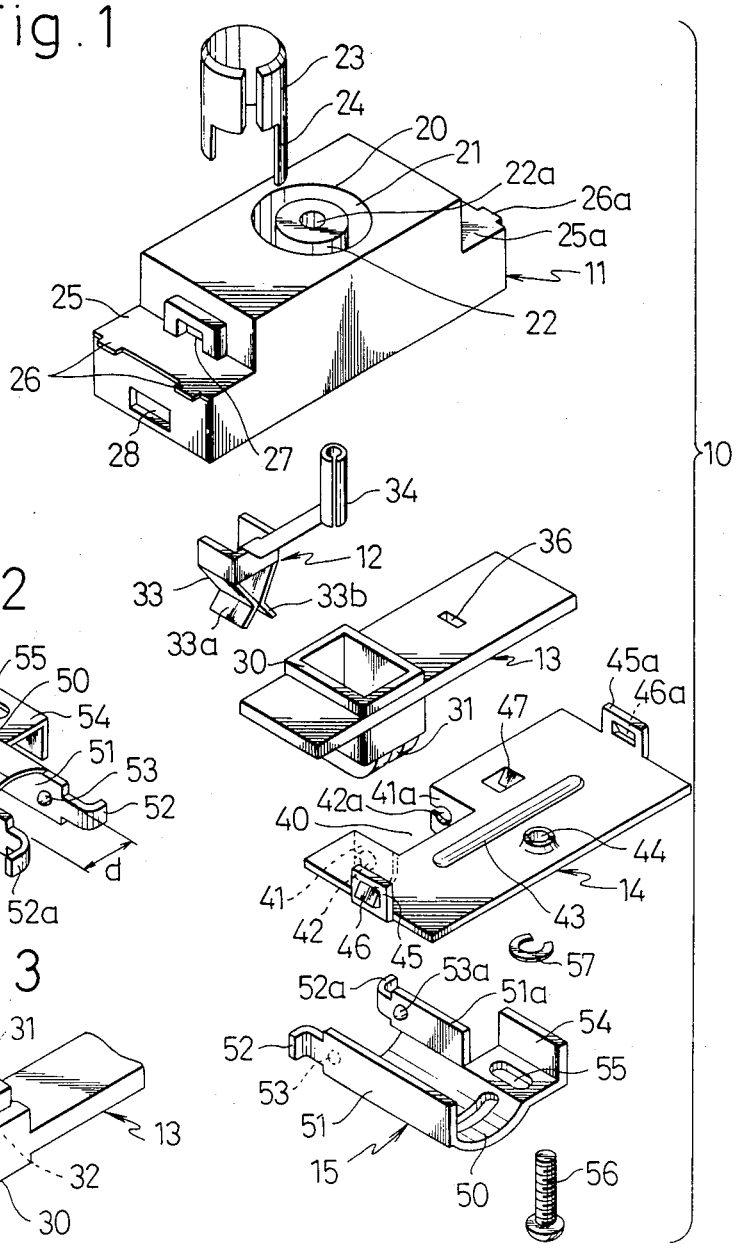
FIG. 1 is a perspective view as disassembled of the high-frequency cable connector in an embodiment of the present invention.

While the invention shall now explained with reference to the embodiments shown in the drawings, it should be appreciated that the intention is not to limit the subject invention only to the embodiments shown herein, but to rather include all of alterations, modifications and equivalent arrangements possible within the scope of appended claims.

DISCLOSURE OF PREFERRED EMBODIMENTS

Figure 2:
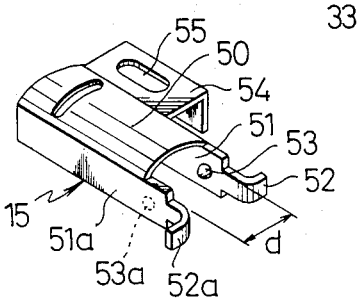
FIG. 2 is a perspective view of the cap member in the connector of FIG. 1 as seen in different direction from FIG. 1.
Figure 3:
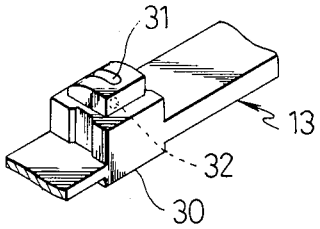
FIG. 3 is a perspective view of the contactor holder in the connector of FIG. 1 also as seen in different direction from FIG. 1.
Figure 4:
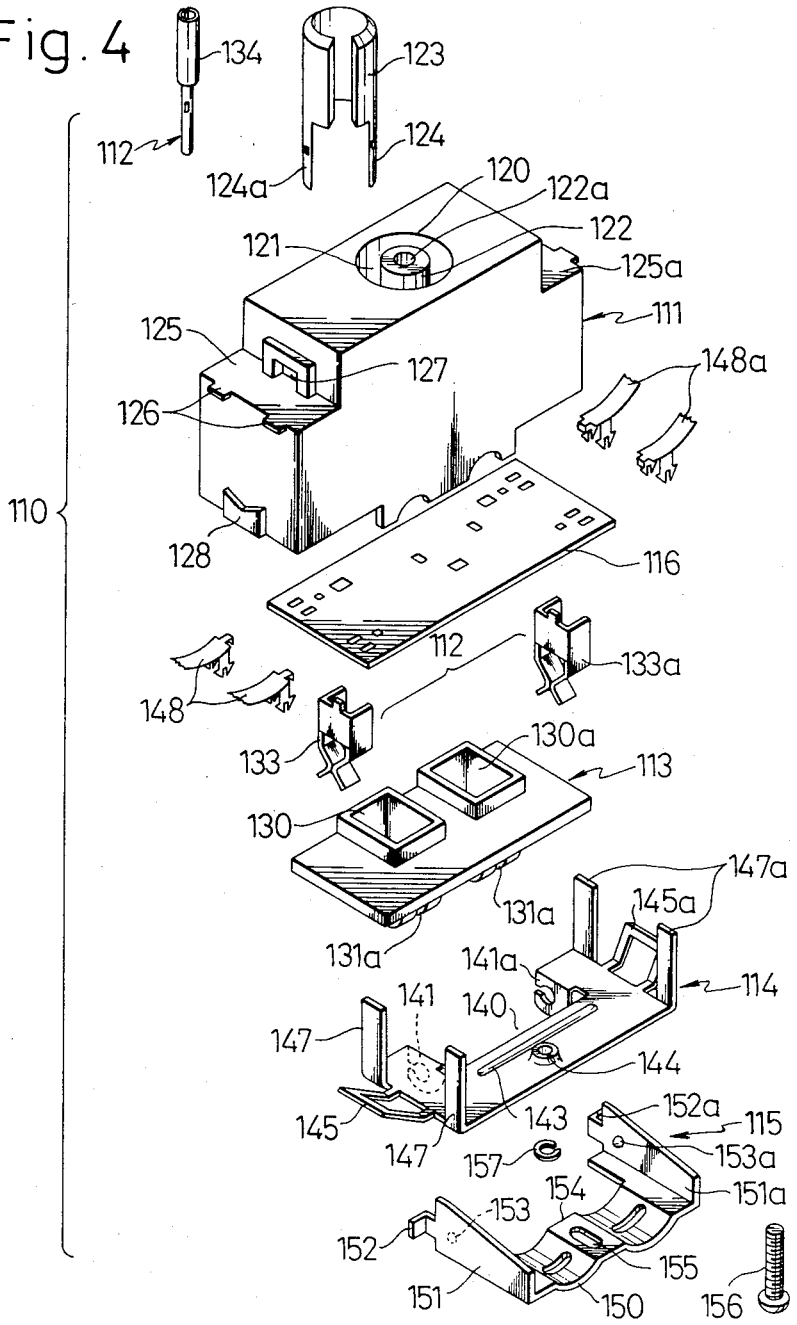
FIG. 4 is a perspective view as disassembled of the connector in another embodiment of the invention.
Figure 6:
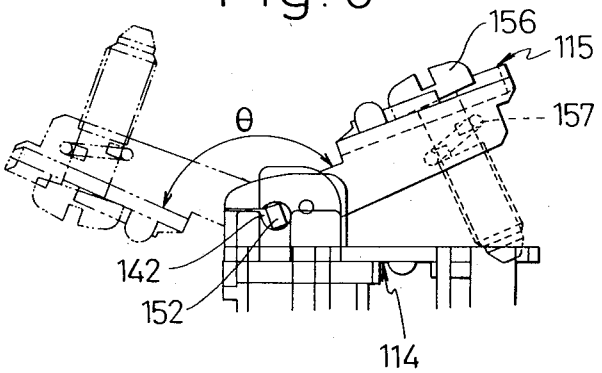
FIG. 6 is an explanatory view for operation of the cap member in the connector of FIG. 4.
Figure 7:
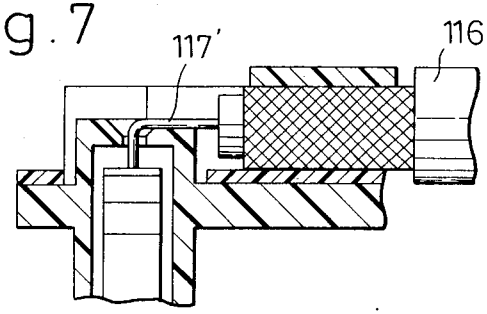
FIG. 7 shows in a fragmentary sectioned view the connector employing the inner contactor holder in another embodiment.
Figure 5:
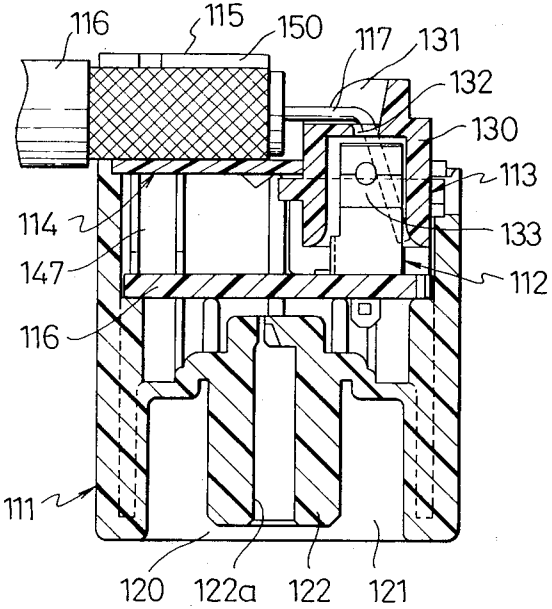
FIG. 5 shows in sectioned view as assembled the connector of FIG. 4.
Figure 8:
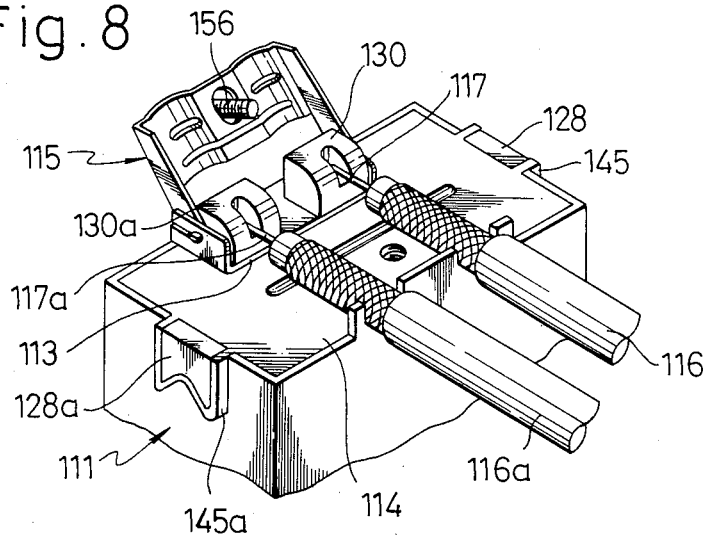
FIG. 8 is an explanatory perspective view for a state in which two of the other side cables are connected to the connector of FIG. 4.
Figure 9:
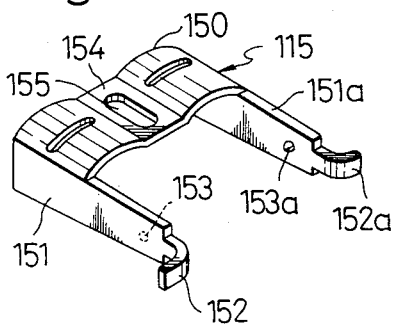
FIG. 9 is a perspective view of the cap member employed in the connector of FIG. 4 as seen in different direction from FIG. 4.
Figure 10:
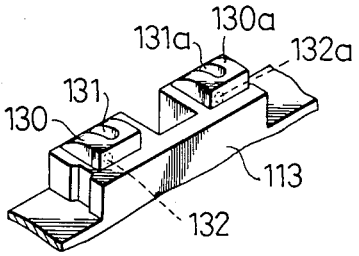
FIG. 10 is a fragmentary perspective view showing the contactor holder in the connector of FIG. 4 as seen in different direction thereform.

Referring here to FIGS. 1 to 3, a high-frequency cable connector according to the present invention comprises a case body 11 opened on the bottom side, an inner contactor holder 13 provided for holding an inner contactor 12 and to be accommodated within the case body 11, a shield plate 14 to be fitted to the open bottom of the case body 11, and a cap member 15 mounted rotatably to the shield plate.

The case body 11 is formed to have in its front side face a receptacle 20 provided for receiving therein a plug (not shown) connected to an end of a coaxial cable connected at the other end to, for example, a relay-antenna terminal plate on a housing of TV receiver or the like, and this receptacle 20 comprises a cylindrical recess 21 made in the case body 11, a cylindrical projection 22 made coaxially in the recess 21 and to have an axial through hole **22*a*, and an outer contactor 23 fitted about the cylindrical projection 22 for contact with outer conductor of the cable plug inserted into the receptacle 20. The outer contactor 23 has a leg 24 extended downward into the interior of the case body 11 as passed through the bottom of the cylindrical recess 21 and through the inner contactor holder 13 to reach the shield plate 14. Preferably, the case body 11 is formed with a plastics in a modular-dimension, so as to be mountable to a mounting frame (not shown here) generally employed in mounting to an interior wall of buildings a plurality of wiring devices which are in the modular-dimension. For this purpose, the case body 11 is formed to have stepped parts 25 and 25*a* at opposite end parts, a pair of engaging projections 26 or 26*a* at each of outer end edges of the stepped parts 25 and 25*a*, and engaging recesses 27 and 27*a* in both inner walls of the stepped parts 25 and 25*a* (only one of which recesses is seen), so that they will engage corresponding parts of the mounting frame. In both end walls of the case body 11, there are made small apertures 28 and 28*a* (only one is seen) for engaging therein the shield plate 14**.

The inner contactor holder 13 is formed preferably with a transparent plastic material generally into a plate shape which has a bulging part defining a generally box-shaped compartment 30 for accommodating part of the inner contactor 12. Top side of the compartment 30 is opened while bottom side is formed to have a guide slot 31 for guiding and passing therethrough the inner conductor of another coaxial cable (not shown here) connected for example, to a TV antenna. This slot 31 is made to expand from bottom of the compartment 30 to one side wall thereof to continue in a sector shape and to communicate with the interior through an inserting hole 32 for the inner conductor of the cable. Within the compartment 30, one contacting part 33 in a first shape of the inner contactor 12 can be seated, while this contacting part 33 comprises a pair of contact spring parts **33*a* and 33*b* respectively bent into L-shape and opposed to resiliently engage each other at their bent parts. The inner contactor 12 has a further contacting part 34 formed in a second shape which is tubular here and integral through an arm 35 with the first-shaped contacting part 33, and the tubular contacting part 34 including longitudinal slit is formed to be able to be inserted into the axial hole 22*a* in the cylindrical projection 22 of the receptacle 20 in the case body 11. In the inner contactor holder 13, further, a penetrating hole 36 is made in the plate-shaped part for passing therethrough the extended leg 24 of the outer contactor 23**.

The shield plate 14 is made of a conductive material and is formed to have in a longitudinal side a relatively large notch 40 for allowing the bottom part of the compartment 30 of the inner contactor holder 13 projected out of the plate 14. At opposing edges of the notch 40 in the longitudinal direction of the plate 14, a pair of holding projections 41 and **41*a* are provided by bending downward the plate in making the notch, and pivoting holes 42 and 42*a* are made in these projections 41 and 42*a*. In the center of the shield plate 14, a stripe of upward raised land 43 is formed to extend in the longitudinal direction of the plate, and a threaded hole 44 is provided substantially in the middle besides the stripe land 43. At both longitudinal ends of the shield plate 14, further, a pair of engaging arms 45 and 45*a* are erected upward and engaging projections 46 and 46*a* are provided on outer side of the arms 45 and 45*a* for engaging in the small apertures 28 and 28*a* of the case body 11. A small tongue piece 47 is formed by bending down a part of the plate 14 for contacting therewith the extended leg 24 of the outer contactor 23 in the case body 11**.

The cap member 15 is formed from a conductive plate substantially into a U-shape in section, having an arcuately curved center part 50 and both side parts 51 and **51*a* extending in parallel to each other, while these side parts 51 and 51*a* are extended at their one end beyond the central part 50 and bent outward to separate from each other to form L-shaped pivoting legs 52 and 52*a* which are engaged in the pivoting holes 42 and 42*a* made in the holding projections 41 and 41*a* of the shield plate 14, so that the cap member 15 will be rotatable about the legs 52 and 52*a* as fulcrum for more than 90 degrees on the other end side with respect to the shield plate 14. In this case, the side parts 51 and 51*a* are made to define a distance d which is substantially equal to the outer width of the compartment 30 of the holder 13 projecting out of the shield plate 14, while the side parts 51 and 51a are provided at their opposing positions with inward dowels 53 and 53a so that, when the cap member 15 is pivoted toward the shield plate 14, the cap member 15 will be normally kept slightly separated from the plate 14 by the dowels 53 and 53a abutting bottom end edges of the compartment 30 but, as the member 15 is further urged to rotate, the member 15 may rest on the plate 14 with the dowels 53 and 53a resiliently engaged to side walls of the compartment 30. One side part 51a of the cap member 15 is partly extended laterally outward to be L-shaped in section to constitute a fixing part 54, and a through hole 55 is made in flat part continuing to the center part 50 so that, when a fixing screw 56 is passed through the hole 55 and fastened into the threaded hole 44 in the shield plate 14 with a spring washer 57 interposed, the cap member 15 can be fixed to the shield plate 14** in the rest position thereon.

Referring to assembling work of the above described high-frequency cable connector as well as connecting work thereto of the coaxial cables from two different sides, the outer contactor 23 is fitted onto the cylindrical projection 22 in the receptacle 20 of the case body 11, one contacting part 33 of the inner contactor 12 is inserted into the compartment 30 of the inner contactor holder 13, and then the holder 13 is inserted within the case body 11 from the open bottom side while concurrently inserting the tubular contacting part 34 of the inner contactor 12 into the axial hole 22a of the cylindrical projection 22 of the case body 11, with the extended leg 24 of the outer contactor 23 passed through the penetrating hole 36 of the holder 13. Then, the shield plate 14 is fitted to the open bottom of the case body 11 with the bottom part of the compartment 30 of the holder 13 fitted to the notch 40 to expose it to the exterior, and is secured to the open bottom of case body 11 by engaging the projections 46 and 46a of the engaging arms 45 and 45a into the engaging apertures 28 and 28a, with the extended leg 24 of the outer contactor brought into contact with the tongue piece 47 of the shield plate. Thereafter, the pivoting legs 52 and 52a of the cap member 15 are inserted in the pivoting holes 42 and 42a of the holding projections 41 and 41a, and the screw 56 is fastened through the spring washer 57 and through hole 55 of the fixing part 54 of the cap member 15 into the threaded hole 44 of the shield plate 14 to fix the cap member 15 to the shield plate 14 with the dowels 53 and 53a of cap member 15 urged to resiliently engage the wall of the compartment 30. The high frequency cable connector can be thus assembled sequentially and only from one side of the connector.

The plug not shown but provided to an end of the coaxial cable connected to the TV receiver or the like is inserted into the receptacle 20 in the case body 11, upon which the outer conductor of the plug is brought into tight contact with the outer contactor 23 in the receptacle 20 of the connector 10, while the inner conductor of the plug concurrently inserted into the axial hole 22a of the cylindrical projection 22 comes into tight contact with the tubular contacting part 34 of the inner contactor 12 disposed in the hole 22a. The other coaxial cable connected to the TV antenna or the like is to be held at its outer conductor between the conductive shield plate 14 and the arcuate center part 50 of the cap member 15, in which event the fixing screw 56 is once unfastened, the cap member 15 is rotated about the legs 52 and 52a as fulcrum to separate the center part 50 from the shield plate 14, the outer conductor of the other cable is fitted to the shield plate 14 at its position adjacent the exposed compartment 30 while inserting the exposed inner conductor of the cable through the guide slot 31 and inserting hole 32 into the interior of the compartment 30, and the cable's inner conductor is brought into contact with the first-shaped contacting part 33 of the inner contactor 12 as held between the pair of contact spring parts 33a and 33b. The cap member 15 is rotated back onto the cable's outer conductor and the fixing screw 56 is fastened again through the fixing part 54 of the member 15 into the threaded hole 44 of the shield plate 14, and thereby the outer conductor of the cable can be tightly contacted with the shield plate 14 by the cap member 15, whereby the both side coaxial cables are relay-connected to each other, with their outer conductors connected through the conductive shield plate 14 and with their inner conductors through the inner contactor 12.

Figure 13:
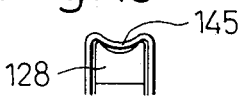
FIG. 13 is a fragmentary side view showing engaging relationship between the case body and the shield plate in the connector of FIG. 4.

According to another feature of the present invention, there is suggested a connector which allows two of the coaxial cables both of which are connected to the TV antennas or the like to be connected to another cable connected to the TV receiver or the like. Referring to FIGS. 4 to 12, substantially equal members therein to those in the foregoing embodiment of FIGS. 1 to 3 are denoted by the same reference numerals but added by 100. In the present instance, it will be appreciated that the case body 111, inner contactor holder 113, shield plate 114 and cap member 115 are respectively enlarged in the longitudinal direction, except for the cap member 115 which is enlarged in width direction, for the concurrent connection of the two coaxial cables. Thus, the inner contactor holder 113 plastic-made is formed to have two compartments 130 and 130a which are provided with the guide slots 131, 131a and inserting holes 132, 132a. The conductive shield plate 114 is also enlarged in the notch 140 for receiving the two compartments 130, 130a to expose them outside and, instead of the tongue piece 47, two pairs of connecting arms 147 and 147a which are respectively erected at corners of both longitudinal ends of the plate 114 are provided. At the same longitudinal ends of the shield plate 114, a pair of frame-shaped hook members 145 and 145a are provided to the shield plate 114, so as to be bent upward to engage about endwise projections 128 and 128a of the case body 111 provided instead of the engaging apertures 28 and 28a, the upper sides of these hook members 145 and 145a being calked inward to be tightly coupled to the projections 128 and 128a (as seen in FIG. 13). Further, the cap member 115 is widened to have double arcuate parts 150 for matching to the two coaxial cables, while the through hole 155 for passing the fixing screw 156 is made in the center of the cap member 115 between the double arcuate parts 150.

In the present instance, the inner contactor 112 is formed as divided into three parts which are mutually connected through a printed circuit board 116. Thus, the first-shape contacting part of L-shape bent legs is provided in a pair 133 and 133a to be accommodated in the two compartments 130 and 130a and connected at their top projections to corresponding circuit parts of a printed circuit on the board 116. The other tubular contacting part 134 fitted in the axial hole 122a in the cylindrical projection 122 of the case body 111 is connected at downward extended leg to a corresponding circuit part of the printed circuit of the board 116, so that the respective contacting parts 133, 133*a* and 134 of the inner contactor 112 are mutually connected through predetermined circuit parts of the board 116.

Figure 14:
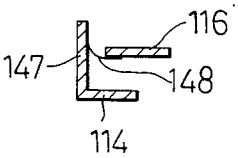
FIG. 14 is a fragmentary sectioned view showing contacting relationship between the shield plate and a conducting spring in the connector of FIG. 4.
Figure 11:
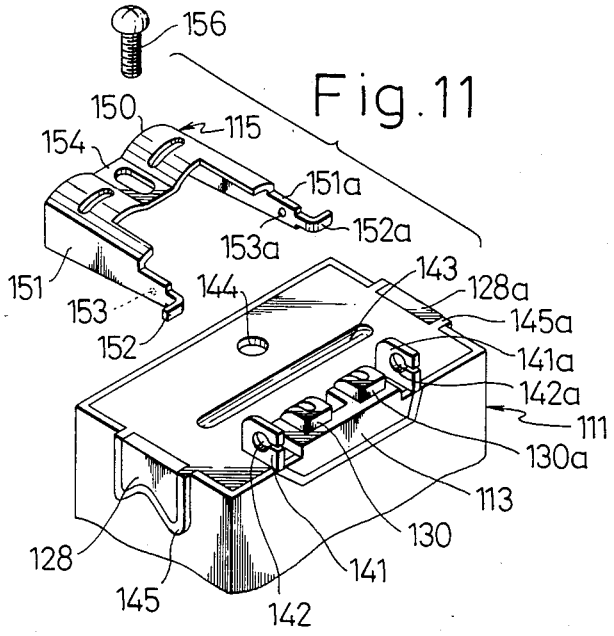
FIG. 11 is a perspective view as disassembled of the case body with the shield plate and cap member secured to the body of the connector in FIG. 4, as shown in different direction from FIG. 4, but with part of the case body omitted.
Figure 12:
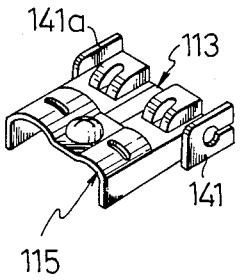
FIG. 12 is a perspective view showing coupling relationship of the contactor holder, shield plate and cap member in the connector of FIG. 4.

The outer contactor 123 fitted about the cylindrical projection 122 in the receptacle 120 is made to have two downward extended legs 124 and 124*a* which are brought into contact also with their corresponding circuit parts in the printed circuit board 116, two pairs of conducting springs 148 and 148*a* are provided to four corners of the board 116 preferably by mechanically fitting them to predetermined holes or slits made in the board 116 to be connected to corresponding circuit parts thereof and to be elastically brought into contact with the erected connecting arms 147, 147*a* of the shield plate 114 (as seen in FIG. 14), and thereby the outer contactor 123 is connected, through the extended legs 124, 124*a*, springs 148, 148a and erected arms 147, 147*a*, to the shield plate 114, respectively through a proper circuit part of the board 116.

Other arrangements in the present embodiment are substantially identical to the foregoing embodiment of FIGS. 1 to 3, and the high-frequency cable connector 110 can be completed by assembling the respective elements in a single assembling direction, substantially through the same sequence as in the case of the foregoing embodiment of FIGS. 1 to 3, only with additional steps of connecting to the printed circuit board 116 the inner contactor 112, outer contactor 123 and conducting springs 148, 148*a*, and of incorporating the circuit board 116 into the case body 111 prior to the insertion of the inner contactor holder 113. In the present instance, as in the case of the embodiment of FIGS. 1 to 3, the cap member 115 is made pivotable by an angle $\theta$ about the extended legs 152, 152*a* as fulcrum (see FIG. 6), in which pivoted position the inner conductors 117, 117*a* of the coaxial cables 116, 116*a* are bent and inserted through the guide slots 131, 131*a* and holes 132, 132*a* into contact position with the bent contacting parts 133, 133*a* of the inner contactor 112 (see in particular FIG. 5), where the inner conductors 117, 117*a* are prevented from being disconnected by means of a stress due to their bending as well as elastic holding force of the contacting parts 133, 133*a*, while effectively connecting the inner conductor 117, 117*a*. As shown further in FIG. 7, it is possible to increase the effective force to the prevention of disconnection of the inner conductor 117' by bending the conductor substantially completely into L-shape. Other operation and effect of the present embodiment are substantially the same as in the embodiment of FIGS. 1 to 3.

Figure 15:
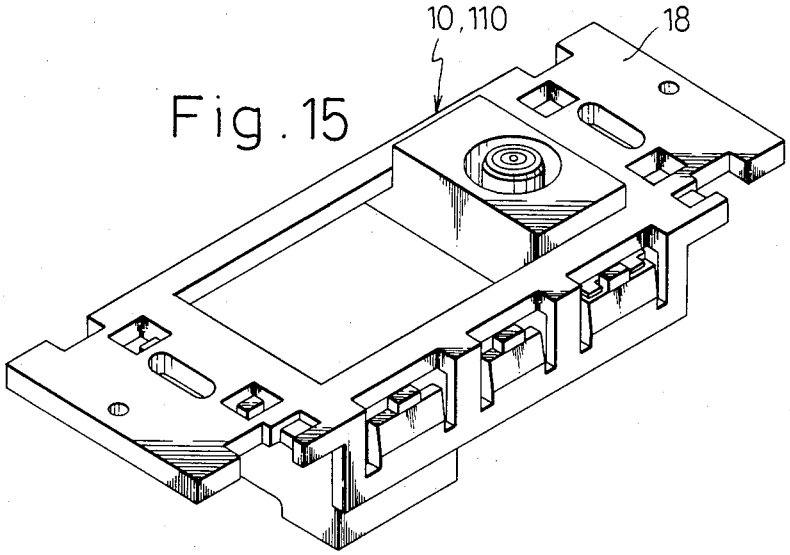
FIG. 15 is a perspective view of the connector of FIG. 1 or FIG. 4, shown in an example in which the connector is subjected to a modular dimension and is mounted to a mounting frame generally employed for mounting the modular-dimensioned wiring devices to building's wall surface.

The high-frequency cable connector of the foregoing structure can be subjected to the modular-dimension so that, as shown in FIG. 15, the connector 10 or 110 can be mounted to a generally used mounting frame 18 for concurrent mounting thereto with the same type of or any different type of the wiring devices, by directly engaging the projections 26, 26*a* or 126, 126*a* to the frame 18, or by means of known L-shaped member engaged in engaging recesses 27, 27*a* or 127, 127*a*.

What we claim as our invention is:

1. A high-frequency cable connector of the type receiving a plurality of coaxial cables at respective separate sides of the connector, said connector establishing a relay connection between those cables and comprising:

a case body defining a front said and an open rear side, a front surface extending across said front side and including a receptacle adapted to receive a plug at the end of a first of the cables, an outer contactor disposed in said receptacle for making connection with an outer conductor of the first cable, said outer contactor including an external leg extending into said body toward said open rear side, a holder disposed within said body and including a compartment, inner contactor means disposed within said body between said front surface and said holder, said inner contactor including a first contacting part disposed in said compartment so as to be accessible to an inner conductor of a second of said cables at said rear side of said body, and a second contacting part electrically coupled to said first contacting part and arranged to make connection with an inner conductor of the first cable and thereby electrically couple the inner conductors of the first and second cables, an electrically conductive shield plate extending across said open rear side to shield said open rear side while exposing said first contacting part for contact with the second cable, said shield plate being electrically coupled to said extended leg of said outer contactor and enclosing the remainder of said open rear side, a cap member including first and second ends, said first end being mounted to said shield plate to enable said second end to be displaceable toward and away from said shield plate between first and second positions, respectively, in said second position said cap member being arranged to receive the second cable to enable an inner conductor thereof to be connected to said first contacting part, in said first position, said cap member retaining the second cable such that an outer conductor thereof is electrically coupled to said shield plate and thus is electrically coupled to an outer conductor of the first cable through said outer contactor, and a screw for securing said cap member in said first position thereof and to said shield plate.

2. A connector acoring to claim 1, wherein said first contacting part comprises a pair of contacting springs capable of elastically holding the inner conductor of the second cable.

3. A connector according to claim 2, wherein said compartment is arranged to receive the inner conductor of the second cable which is bent to be extended into the compartment.

4. A connector according to claim 1, wherein said cap member is provided with means for normally keeping said second end of said cap member slightly separated from said shield plate.

5. A connector according to claim 4, wherein said keeping means comprises dowels projected from said cap member and engageable with a lower end of said compartment.

6. A connector according to claim 1, wherein said second contacting part is disposed in a cylindrical projection formed in said receptacle, and is integral with said first contacting part.

7. A connector according to claim 6, wherein aid outer contactor is fitted onto said cylindrical projection.

8. A connector according to claim 1, wherein aid case body, said holder, said shield plate and said cap member are respectively formed to receive two of the second cables, said inner contactor means includes two of said first contacting parts, and said holder includes two of said compartments for accomodating respectively said two first contacting parts.

9. A connector according to claim 8, wherein said receptacle of said case body includes a cylindrical projection, said second contacting part is disposed within said cylindrical projection, and which further comprises a printed circuit board disposed within said case body for connecting said two first contacting parts to said second contacting part.

10. A connector according to claim 9, wherein said outer contactor is fitted onto said cylindrical projection and electrically contactable through said extended leg with said printed circuit board, said shield plate including erected contacting arms contactable respectively through a conducting spring with the printed circuit board, and said outer contactor and shield plate being connected with each other through the printed circuit board.

* * * * *